US007914326B2

(12) United States Patent
Sutter

(10) Patent No.: US 7,914,326 B2
(45) Date of Patent: Mar. 29, 2011

(54) COAXIAL CABLE CONNECTOR

(75) Inventor: Robert W. Sutter, De Kalb, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 12/504,503

(22) Filed: Jul. 16, 2009

(65) Prior Publication Data

US 2010/0093211 A1 Apr. 15, 2010

Related U.S. Application Data

(60) Provisional application No. 61/104,797, filed on Oct. 13, 2008.

(51) Int. Cl.
*H01R 9/05* (2006.01)

(52) U.S. Cl. ..... 439/584; 439/578; 439/910

(58) Field of Classification Search ..... 439/584, 439/578, 910, 583, 587
See application file for complete search history.

(56) References Cited

U.S. PATENT DOCUMENTS

| | | | | |
|---|---|---|---|---|
| 4,902,246 | A | 2/1990 | Samchisen | |
| 5,138,864 | A * | 8/1992 | Tarpill | 72/409.12 |
| 5,454,730 | A | 10/1995 | Tozuka | |
| 6,089,913 | A | 7/2000 | Holliday | |
| 6,261,126 | B1 * | 7/2001 | Stirling | 439/583 |
| 6,558,194 | B2 | 5/2003 | Montena | |
| 6,743,044 | B2 | 6/2004 | Musolf et al. | |
| 6,848,939 | B2 * | 2/2005 | Stirling | 439/578 |
| 7,004,788 | B2 * | 2/2006 | Montena | 439/578 |
| 7,021,965 | B1 * | 4/2006 | Montena et al. | 439/578 |
| 7,153,159 | B2 | 12/2006 | Burris et al. | |
| 7,182,639 | B2 | 2/2007 | Burris | |
| 2005/0020128 | A1 * | 1/2005 | Montena | 439/578 |
| 2007/0093128 | A1 * | 4/2007 | Thomas et al. | 439/578 |
| 2008/0045082 | A1 * | 2/2008 | Kuo | 439/584 |
| 2008/0171466 | A1 * | 7/2008 | Buck et al. | 439/578 |
| 2010/0035457 | A1 * | 2/2010 | Holliday | 439/345 |

OTHER PUBLICATIONS

PCT/US2009/060207, International Search Report and Written Opinion of the International Searching Authority, mailed Dec. 3, 2009.

Stirling, "SPL-6-RTQ-PC Universal Compression Fitting For 6 Series Cable," Advertisement, 2007.

Ideal, "OmniCONN Compression RCA and F Connectors," Advertisment, Dec. 2007.

* cited by examiner

*Primary Examiner* — Gary F. Paumen
(74) *Attorney, Agent, or Firm* — Cook Alex Ltd.

(57) ABSTRACT

A coaxial cable connector is provided with a generally tubular mandrel. An attachment element and a retainer are associated with the mandrel and a bushing is telescopically mounted on the retainer. The bushing is adapted for axial movement along the retainer to a closed position wherein the bushing biases a first portion of the retainer into sealing engagement with a seating surface on the exterior of the mandrel. The retainer is sufficiently translucent to permit visual observation of a cable inserted into the retainer.

21 Claims, 3 Drawing Sheets

COAXIAL CABLE CONNECTOR

CROSS-REFERENCE TO RELATED APPLICATION

This application claims the benefit of U.S. Provisional Application Ser. No. 61/104,797, filed Oct. 13, 2008, the disclosure of which is incorporated by reference herein.

BACKGROUND OF THE INVENTION

The present invention relates to connectors used to attach coaxial cable to a mating port. Coaxial cable is widely used for the transmission of data. A common application is the transmission of television signals from a provider or source to an end user. A typical RG-6 or RG-59 coaxial cable comprises a central conductor surrounded by a dielectric insulator or core, which in turn is surrounded by a conductive shield. The shield is surrounded by a flexible, outer insulative jacket. The conductive shield may include one or more layers of a metallic foil and/or a braided metallic sleeve.

A free end of the coaxial cable is secured to a plug or port of a receiving unit by a coaxial cable connector. Releasable engagement elements are formed on the port and connector. In one typical arrangement the port has external threads that are engageable with internal threads on a nut of the connector. Other connectors use a bayonet type connection to the port. Different types of coaxial cable connectors are available and may be categorized by the manner in which they are secured to the cable. Screw-on type connectors are provided with an inner thread that cuts into the outer jacket of the cable when the connector is screwed onto the end of the cable. While such connectors are easily applied to a cable, many believe that they do not result in optimal signal transmission.

Radial crimp-type connectors include a metallic tubular portion that is placed over the end of the cable and subjected to a radial compression that deforms the tubular portion and causes it to grip the cable securely. Such a connector and an associated crimp tool are described in U.S. Pat. No. 5,138,864. A perceived inability of such connectors to provide a water-tight seal between the connector and cable has led to a decreased use of radial crimp-type connectors.

Axial compression-type connectors employ relative axial movement of two or more elements of the connector to secure the cable within the connector. Typically, such axial movement imparts a radial force that causes a portion of the connector to deform inwardly and grip the cable. For example, U.S. Pat. No. 6,089,913, which is hereby incorporated herein by reference, describes a coaxial cable connector with a crimping ring having a tapered inner surface. The crimping ring surrounds a thin metal sleeve that is coaxial with and spaced from an inner sleeve to form a jacket-receiving gap. The free end of a coaxial cable is pressed into the connector, typically with the central conductor, dielectric and foil layer entering the inner sleeve and the jacket and braided layer of the cable separating from the underlying dielectric insulator to occupy the jacket-receiving cavity between the inner and outer sleeves of the connector. With the cable so inserted in the connector, the crimping ring is advanced axially along the outer sleeve, which eventually causes the tapered inner surface of the crimping ring to bear against the outer sleeve. As the crimping ring continues to slide along the outer sleeve, it deforms the thin metal sleeve inwardly, thereby decreasing the gap between the sleeves of the connector and pinning the jacket and braided layer between the sleeves.

Another axial compression type connector is shown in U.S. Pat. No. 6,261,126, the disclosure of which is hereby incorporated herein by reference. In this connector the outer sleeve is not deformed during axial compression of a bushing. Instead, the bushing has a trailing end that has a reduced internal diameter that impinges on the cable jacket and pinches it between the bushing and the inner sleeve. A similar axial compression type connector is shown in U.S. Pat. No. 6,848,939, the disclosure of which is hereby incorporated herein by reference. It has an inner collar inside a bushing for engaging the jacket.

Regardless of the type of connector employed, a secure fit between the connector and the cable is important. An improperly fit connector-cable pair can become disengaged or provide an incomplete seal, which risks allowing moisture into the connector, thereby degrading the performance of the cable. Furthermore, the initial seating of the cable in the connector is important to assure a secure connection. Although tools are available for the purpose, the initial seating is typically done manually with the technician simply holding the connector in one hand and pressing the prepared cable end into the connector with the other hand. To make a proper connection the cable must advance fully into the connector but in some types of connectors the technician cannot see the interior of the connector to know where the cable is in relation to the connector.

It is also important that the connector seals against moisture entering the connector. While many connectors are installed indoors where moisture is not expected to be an issue, some will be installed in locations where moisture will definitely be a concern. Installers do not want to maintain inventories of "indoor" and "outdoor" connectors so one connector type must be suitable for both applications. In the past O-rings have been widely used to provide the necessary seals. While O-rings are generally effective, they do add cost and complexity to the connector. In some designs more than one O-ring is required to seal all the possible leakage paths. Press fitting parts of the connector together can also provide moisture seals but doing so adds to the complexity of the connector assembly process and the equipment needed in the factory.

SUMMARY OF THE INVENTION

There are several aspects of the present subject matter which may be embodied in the devices and systems described and claimed below. These aspects may be employed alone or in combination with other aspects of the subject matter described herein.

A coaxial cable connector has a generally tubular mandrel. The mandrel has a wall that defines an interior cylindrical bore. The cylindrical bore is sized for receiving at least the central conductor and dielectric core of a coaxial cable inserted into the connector. A seat surface is formed on the exterior of the wall. At least one locating member, such as a shoulder, is also formed on the exterior of the mandrel wall.

A retainer has a first portion in engagement with the locating member to axially fix the location of the retainer on the mandrel. The first portion of the retainer also includes a collar having a counterbore. The counterbore defines an interior surface which is in facing relation with the seat surface of the mandrel. A second portion of the retainer forms a sleeve which is connected to the collar and spaced from the mandrel to define a cavity between the exterior of the mandrel and an internal surface of the sleeve. The cavity is sized for receiving at least a braided sleeve of the shield and the jacket of a coaxial cable inserted into the connector.

A bushing is telescopically engageable with the retainer. The bushing slides axially on the retainer from a first, open position to a second, closed position. When the bushing is in the first, open position the bushing is axially spaced from the retainer's collar and the interior surface of the collar is in non-sealing relation with the seat surface of the mandrel. When the bushing is in the second, closed position, the bushing engages the collar to bias its interior surface into sealing engagement with the seat surface.

The connector further includes an attachment element which is non-releasably engageable with the mandrel or the retainer. The attachment element is releasably engageable with the port of a device to which the cable is to be connected.

According to another aspect of the present disclosure, a coaxial cable connector is provided with a generally tubular mandrel. An attachment element and a retainer are associated with the mandrel, with a bushing being associated with the retainer. The bushing is adapted for movement along the retainer and the retainer is sufficiently translucent or transparent to permit visual observation of the cable jacket within the retainer. This allows the installer to know when the cable has been properly seated within the connector.

In another aspect of the present disclosure, some of the components of the connector may have a lubricant applied thereto to reduce the cable insertion force and make relative movement of the connector components easier.

DETAILED DESCRIPTION OF THE INVENTION

The embodiments disclosed herein are for the purpose of providing the required description of the present subject matter. These embodiments are only exemplary, and may be embodied in various forms. Therefore, specific details disclosed herein are not to be interpreted as limiting the subject matter as defined in the accompanying claims.

Figure 1:
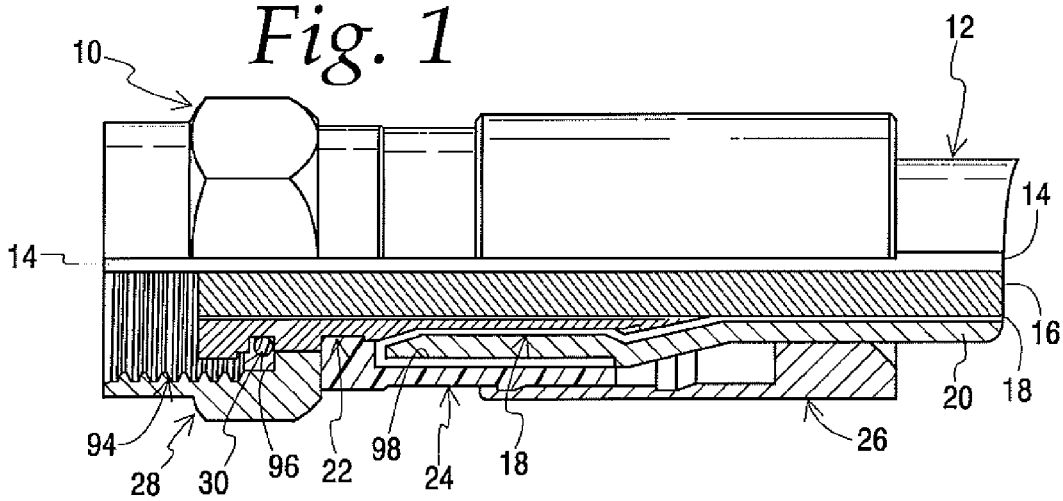
FIG. 1 is a side elevation view, with the lower half in cross-section, of a coaxial cable connector of the present invention, with a coaxial cable positioned therein but prior to closing of the bushing.

FIG. 1 shows a coaxial cable connector 10 suitable for use with a typical coaxial cable. The coaxial cable is shown generally at 12. Coaxial cable typically has a central conductor 14 at the center of the cable. The central conductor is usually made of copper or a copper-plated material. A cylindrical dielectric core 16 encloses the central conductor. A conductive shield 18 surrounds the dielectric core and an outer, insulative jacket 20 in turn surrounds the shield. The shield 18 is shown diagrammatically as a single layer. It will be understood that, depending on the application requirements, the shield may include a metallic foil layer and/or a braided metal sleeve, or multiple foil layers and braided sleeves. In a common arrangement the shield has a foil layer surrounding the dielectric core and a braided sleeve surrounding the foil layer. The shield layers may be made of aluminum. Preparation of the end of a cable entails stripping an end portion of the outer jacket, folding the braided sleeve back on the jacket, and stripping an end portion of the dielectric core to expose an end of the central conductor. The end of the conductor thus prepared is inserted into the end of the connector as will be described below.

Figure 5:
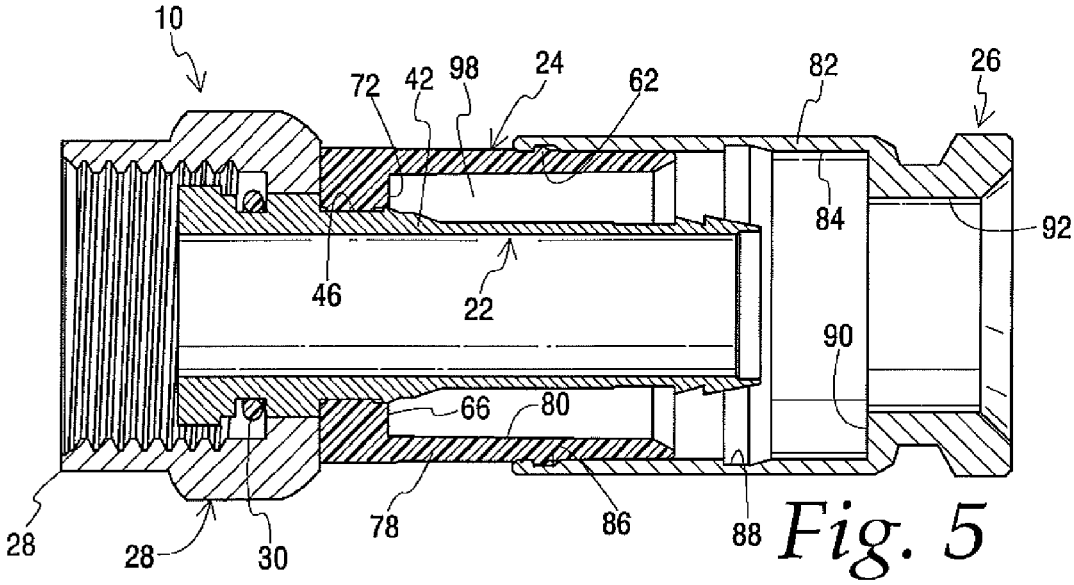
FIG. 5 is a cross-sectional view of the coaxial cable connector with the bushing in a first, open position.

Looking at FIG. 5, the connector 10 includes a generally tubular mandrel 22, a retainer 24, a bushing 26, and an attachment element 28. In this embodiment the attachment element 28 is in the form of a nut. When the connector is installed on a port, the interface between the nut and mandrel is sealed by an O-ring 30. For reference purposes, the connector will be described herein as having a front portion located at the nut, which is the left side as viewed in all of the Figures. The rear of the connector is where the bushing is located, which is the right side in the Figures.

Figure 2:
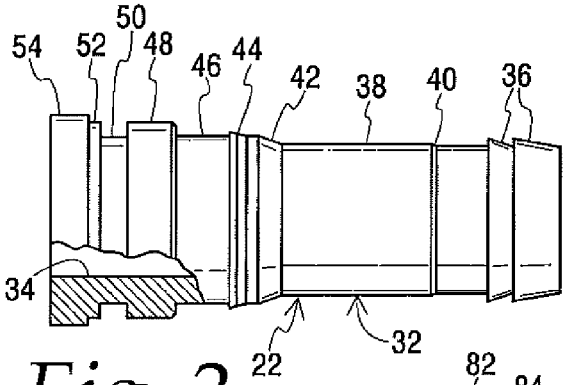
FIG. 2 is a side elevation view of the mandrel with a portion shown in section.

Details of the mandrel 22 are shown in FIG. 2. The mandrel is preferably made of a conductive material, such as brass. The mandrel has a generally tubular wall 32 that defines an interior cylindrical bore 34. The bore is sized to receive the central conductor 14, the dielectric core 16 and, if applicable, the foil layer of the shield of a cable inserted into the connector. The exterior of the wall 32 has several features, including a pair of barbs 36 at the rear end. The barbs 36 are adapted for gripping the inner surface of a cable shield layer. The rear end of the mandrel has a diameter suitable for sliding over the dielectric core 16 and between an inner foil layer and a braided sleeve of the shield 18 of a cable. Moving toward the front end of the mandrel's exterior surface from the barbs 36, the wall 32 has a midsection 38 with a small step at 40. The midsection terminates at a beveled section 42. The beveled section joins a first locating member in the form of a rib 44. Extending forwardly from the rib 44 is a seat surface 46. The seat surface terminates at a second locating member in the form of a shoulder 48. Together the rib 44 and shoulder 48 form locating members that engage the retainer 24 to fix the axial position of the retainer, as will be described below. The front edge of the shoulder 48 is bounded by an O-ring seat 50. Forwardly from the O-ring seat there is a stepped portion 52 which in turn joins an end flange 54. The end flange has the largest outside diameter on the mandrel for purposes of retaining the nut on the mandrel.

Figure 3:
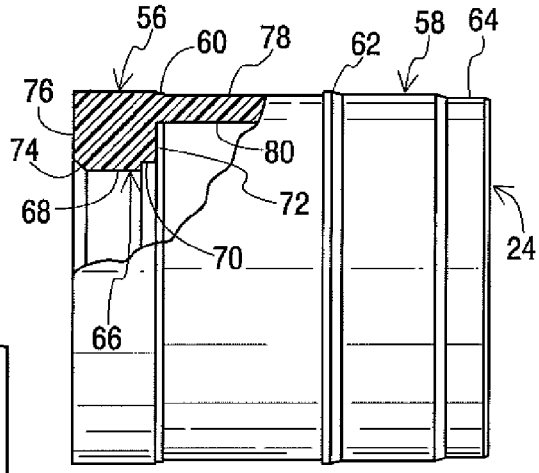
FIG. 3 is a side elevation view of the retainer with a portion shown in section.

Details of the retainer 24 are shown in FIG. 3. The retainer has a generally cylindrical exterior, with a first portion 56 integrally joined to a second portion 58 at boundary 60. It will be noted that the outside diameter of the first portion 56 is slightly greater than that of the second portion 58. The difference in the outside diameters can be approximately 0.004 inches. The exterior of the second portion includes a rib 62 extending radially outwardly. The rear edge of the second portion has slightly reduced outside diameter section 64.

The sectioned portion of FIG. 3 illustrates the interior of the retainer 24. Here it can be seen that the first portion 56 has a radially-extending collar 66. The collar includes a counterbore which defines an interior surface 68 at the inside diameter of the counterbore. There is a notch 70 at the junction of the interior surface 68 with the rear radial face 72 of the collar 66. There is a chamfer 74 at the junction of the interior surface 68 with the front radial face 76 of the collar 66. The second portion 58 of the retainer includes an axially-extending sleeve 78. A bore in the sleeve defines an internal surface 80 of the second portion. The retainer 24 is made of a material that is at least translucent, and preferably substantially transparent. Transparent polycarbonate is an example of a suitable material, although others are possible. As will be described in greater detail below, the retainer is relatively flexible compared to a metal component and it allows for visibility into the interior of the retainer 24 when inserting the free end of a cable.

Figure 4:
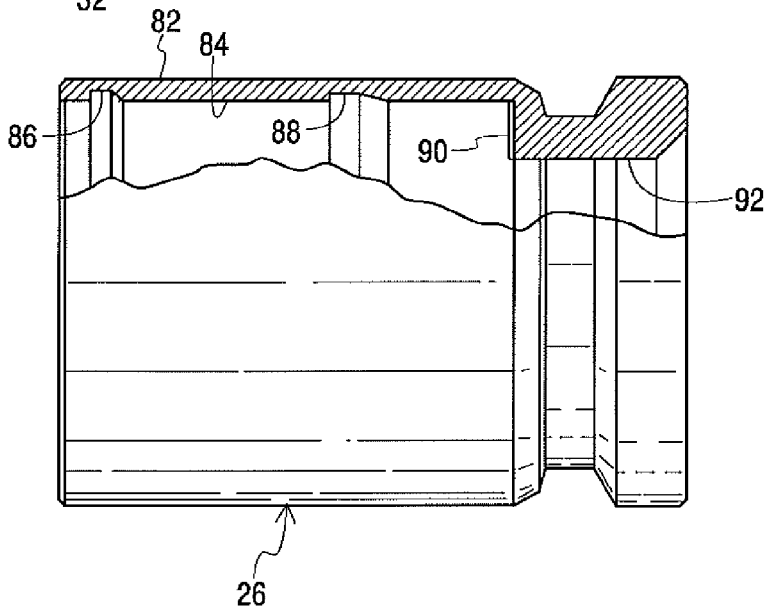
FIG. 4 is a side elevation view of the bushing with a portion shown in section.

Turning now to FIG. 4, details of the bushing 26 will be described. The bushing is made of a substantially rigid material, such as brass. The bushing includes a sleeve 82 with a bore therethrough that defines an interior surface 84. The inside diameter of the bushing's sleeve 82 and the outside diameter of the retainer's sleeve 78 are selected to permit a telescoping engagement of the bushing on the retainer. However, as mentioned above, the outside diameter of the retainer's collar 66 is somewhat greater than the outside diameter of the retainer's sleeve 78. As a result of the relationship between the inner and outer diameters of the bushing and the retainer's collar, respectively, and the retainer being more flexible than the bushing, sliding engagement of the bushing's sleeve 82 onto the collar 66 creates interference that causes the bushing to bias the retainer radially toward the mandrel. Continuing with the details of the bushing, a first rib-receiving groove 86 is formed near the front end of the bushing. A similar second rib-receiving groove 88 is located near the midpoint of the bushing. The rear end of the sleeve 82 joins a radially-extending collar 90. The collar has a counterbore 92 through it.

The attachment element in the form of nut 28 is associated with the front end of the mandrel 22. The nut 28 includes inner threads 94 and may be rotatable with respect to the underlying mandrel 22. A flange 96 on the nut engages the end flange 54 of the mandrel to permit the nut to rotate relative to the mandrel but the nut cannot move axially off the end of the mandrel. When the nut 28 is threaded onto a mating port, the inside diameter of the flange 96 will press the O-ring 30 against the O-ring seat 50 of the mandrel 22, thereby providing a moisture resistant seal between the nut and mandrel.

Figure 6:
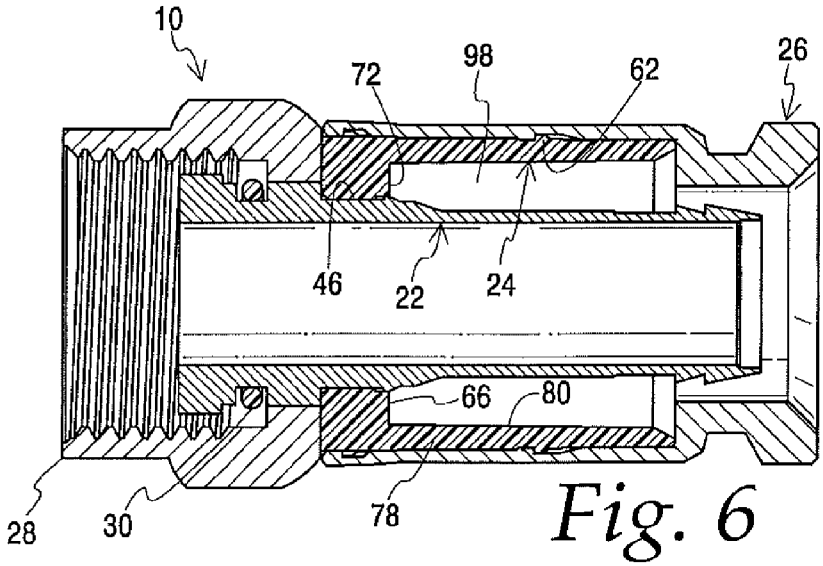
FIG. 6 is a cross-sectional view of the coaxial cable connector with the bushing in a second, closed position.
Figure 7:
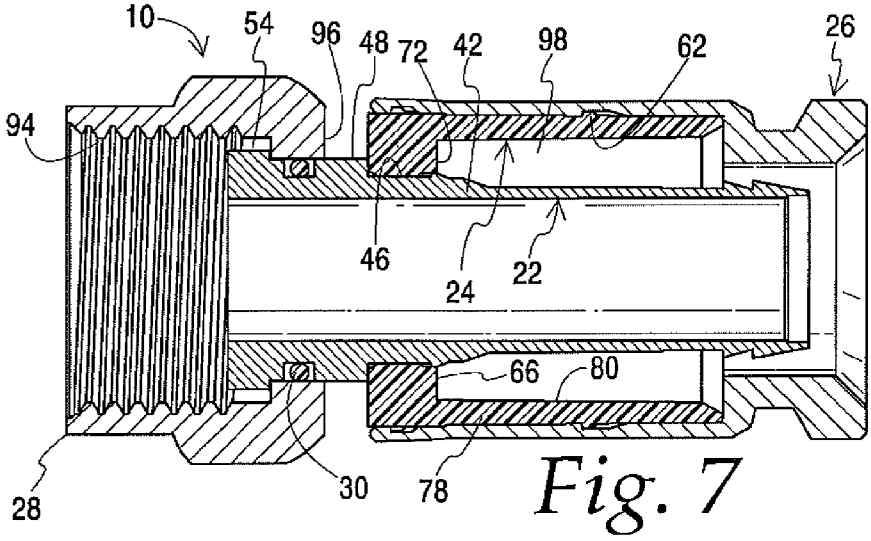
FIG. 7 is a cross-sectional view of the coaxial cable connector with the bushing in a second, closed position and the attachment element in an engaged position.

Assembly of the connector is as follows. First the O-ring 30 is slipped over the mandrel and into the O-ring seat 50. Then the nut 28 is placed over the rear end of the mandrel 22 and advanced forwardly until the nut's flange 96 is opposite the mandrel's shoulder 48, as seen in FIGS. 1, 5 and 6. Next the retainer 24 is placed on the mandrel 22 by sliding the collar 66 over the rear end of the mandrel and advancing the retainer toward the front of the mandrel. When the chamfer 74 engages the beveled section 42, the beveled section centers the retainer on the mandrel. Upon continued advancement of the retainer the rib 44 causes the collar 66 to expand radially to permit the collar to snap fit in between the mandrel's shoulder 48 and rib 44. The notch 70 accommodates the rib 44. The shoulder and rib together serve as locating members to fix the axial position of the retainer on the mandrel. In this position the retainer collar's internal surface 68 is in facing relation with the seat surface 46 on the mandrel. Also, the internal surface 80 of the retainer's sleeve 78 is radially spaced from the exterior surface of the mandrel to define a cavity 98 (FIGS. 5-7). The cavity is sized to receive the braided sleeve of the shield 18 and the jacket 20 of a cable inserted into the connector. The final step in the initial assembly is to place the bushing 26 onto the rear portion of the retainer's sleeve 78. The bushing is advanced until the retainer's rib 62 engages the first rib-receiving groove 86, as seen in FIG. 5. This defines a first, open position of the bushing. In this position the connector is ready to receive the prepared end of a coaxial cable.

The use, operation and function of the connector are as follows. The free end of a coaxial cable is prepared for insertion into the connector 10 as described above. The prepared end of the cable is then inserted into the rear end of the bushing's collar 90. Upon further insertion of the cable the central conductor 14 and dielectric core 16 encounter the rear end of the mandrel. The conductor and core (and foil layer of the shield, if any) enter the bore 34 of the mandrel while the braided sleeve of the shield 18 and the jacket 20 enter the cavity 98 between the mandrel and retainer. Insertion of the cable then continues until the jacket bottoms on the rear radial face 72 of the collar 66. The non-opaque retainer 24 allows the user to visually confirm that the braided sleeve of the shield 18 and the jacket 20 have been fully inserted into the cavity 98. If the strip lengths were correctly made, the dielectric core should then be substantially aligned with the front end of the mandrel.

When the user has confirmed that the cable is fully inserted into the connector 10, the bushing 26 is compressed axially along the retainer 24 until the bushing's collar engages the rear edge of the retainer. This is typically done with the aid of a tool. When the bushing is in the second, closed position the rib 62 is in the second groove 88. Engagement of the rib 62 in groove 88 holds the bushing in this second, closed position. See FIG. 6. As the bushing reaches the second, closed position the collar 90 of the bushing will engage the jacket 20 of the cable. The annular surface of counterbore 92 will pinch the jacket between the collar 90 and the barbs 36 of the mandrel. This prevents retraction of the cable from the connector.

Also, when the bushing moves to the second, closed position the front edge of the bushing engages the outside diameter of the retainer's collar 66. As explained above, the inside diameter of the bushing's front end is less than the outside diameter of the collar so that interference is created when these two components engage. Since the bushing is more rigid than the collar 66, the collar is compressed radially by the forwardly moving bushing. This radial compression causes the interior surface 68 of the collar to engage the seat surface 46 of the mandrel in sealing engagement. Thus, the retainer and mandrel are sealed against entry of moisture into the cavity 98 by the closing motion of the bushing, which creates the biasing force on the retainer that in turn creates the seal. No O-ring or other sealing member is required at the retainer and mandrel interface. This arrangement also has the benefit that initial assembly of the retainer on the mandrel is achieved by a simple snap fit of the collar into the locating members but a tight, sealing contact is not necessary during initial assembly. Sealing contact is achieved during installation of the connector onto a cable.

FIG. 7 schematically illustrates the condition of the connector 10 after it is attached to a plug or port of a mating device. When the nut 28 is tightened onto the port, the port will engage the front surface of the mandrel's end flange 54. Further tightening causes the port to push the mandrel 22 toward the rear, until the rear surface of the end flange engages the flange 96 of the nut. This is what creates the separation between the nut and the retainer as seen in FIG. 7. The rearward movement of the mandrel also carries the O-ring 30 into alignment with the inside diameter of the nut's flange 96, thereby sealing this annular surface.

Figure 11:
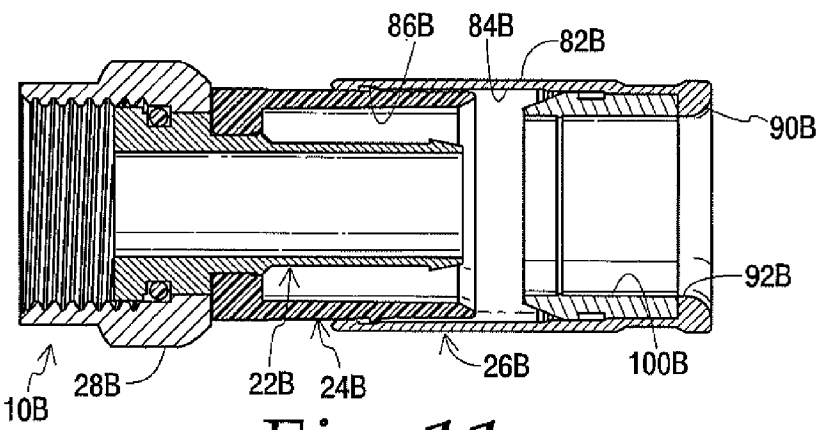
FIG. 11 is a section similar to FIG. 9, showing an alternate embodiment of an F connector with a different bushing from that of the FIG. 1-7 F connector.

As mentioned above, the non-opaque retainer is beneficial in the F-type connector shown in FIGS. 1-7 in that it permits visual indication of complete entry of the cable jacket into the cavity 98. An F connector provides an alternate indicator of full entry of the cable into the connector. The interior of the nut 28 and the front of the mandrel 22 provide an unobstructed view of the ends of the central conductor 14 and the dielectric core 16 as they approach the front end of the connector. Accordingly, as is evident in FIG. 1, it is possible to see when the core 16 reaches the front end of the mandrel, at which point the cable is fully seated on the connector. This alternate indicator of full entry is not available in BNC type connectors. The front end of a BNC connector has a hollow pin on the connector's axis. The pin is supported in a mounting block and receives the central conductor therein. An example of a BNC connector is shown in FIGS. 11 and 11A of U.S. Pat. No. 7,029,326, the disclosure of which is hereby incorporated herein by reference. The pin and its mounting block completely obscure any view at all of the cable from the front of the connector. In a conventional blind BNC connector, i.e., one without a non-opaque retainer, the user can confirm that the cable has been fully inserted into the connector by one of the following, none of which are entirely satisfactory: a tactile indication (i.e., the feel of the jacket abutting a stop surface); a cessation of further movement of the cable into the connector; or placing the connector adjacent to the end of the cable with the center conductor approximately even with the front end of the connector, noting or marking the location on the cable where the rear end of the connector lies and then inserting the cable until the marked location of the cable is even with the rear end of the cable. If the cable snags on a portion of connector, then the user may incorrectly surmise that the cable is fully inserted. There is no way in the standard BNC connector to visually confirm full insertion. Hence, the non-opaque retainer according to the present disclosure is even more important in a BNC connector because it provides the only visual confirmation or indication in a BNC connector that the cable is fully inserted. Full insertion preferably should be confirmed before proceeding with securing the connector to the cable. The present invention's non-opaque retainer permits this in a manner that is not possible with the prior art connectors.

Figure 9:
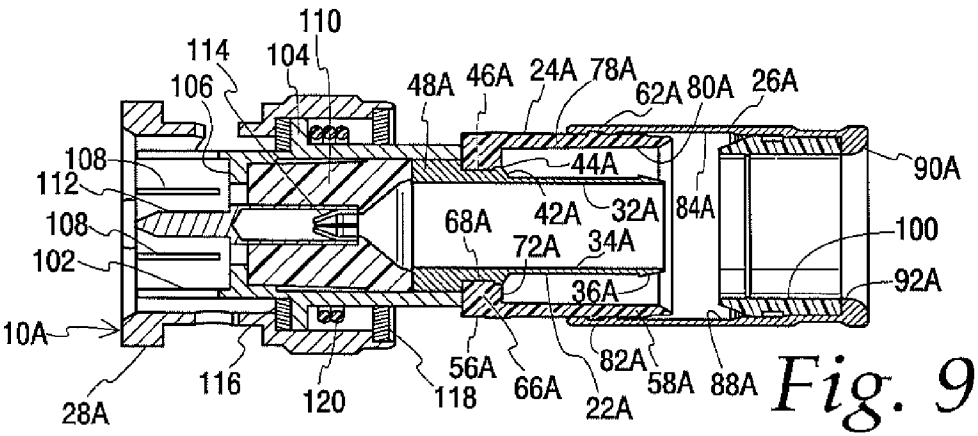
FIG. 9 is a section taken along line 9-9 of FIG. 8, showing the connector in an uncompressed state.
Figure 8:
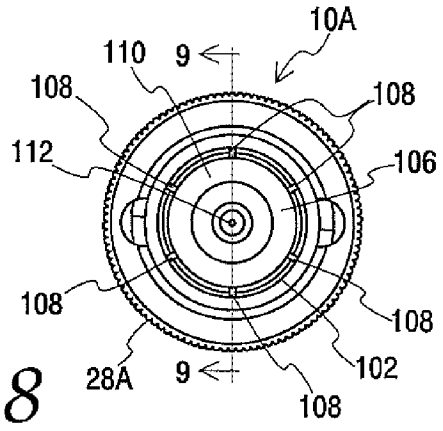
FIG. 8 is an front end elevation view of an alternate embodiment of the present invention, illustrating a BNC-type connector.
Figure 10:
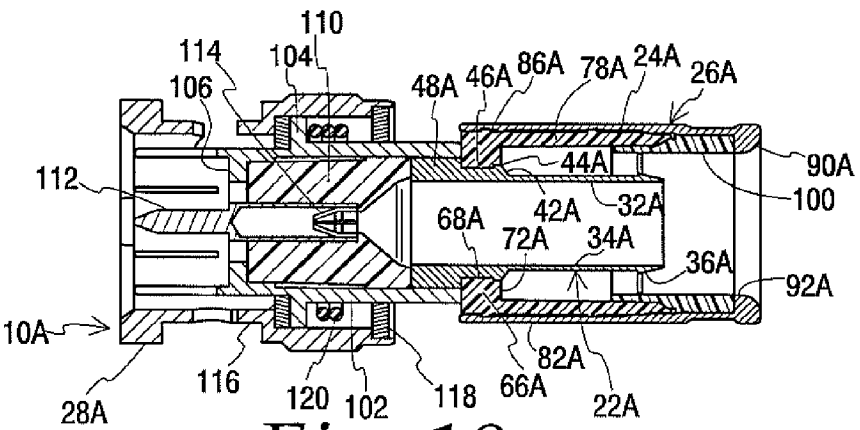
FIG. 10 is a section similar to FIG. 9, showing the connector in a compressed state but with the cable omitted for clarity.

FIGS. 8-10 illustrate a BNC type connector according to the present disclosure. This embodiment has several components that are similar to those of FIGS. 1-7 and these will be given the same reference numerals with the addition of a letter A. Connector 10A includes a mandrel 22A, a non-opaque retainer 24A and a bushing 26A. Attachment element 28A is in the form of a bayonet-type head.

Looking at details of the mandrel 22A, as in the previous embodiment it has a generally tubular wall 32A that defines an interior cylindrical bore 34A with a single barb 36A at the rear end. The wall 32A terminates at a beveled section 42A which joins a first locating member in the form of a rib 44A. Extending forwardly from the rib 44A is a seat surface 46A. The seat surface terminates at a second locating member in the form of a shoulder 48A. Together the rib 44A and shoulder 48A form locating members that engage the retainer 24A to fix the axial position of the retainer, as in the first embodiment.

The retainer 24A has a generally cylindrical exterior, with a first portion 56A integrally joined to a second portion 58A. It will be noted that the outside diameter of the first portion 56A is slightly greater than that of the second portion 58A. The difference in the outside diameters can be approximately 0.004 inches. The exterior of the second portion includes a rib 62A extending radially outwardly.

The interior of the retainer 24A has a radially-extending collar 66A. The collar includes a counterbore which defines an interior surface 68A at the inside diameter of the counterbore. There is a notch at the junction of the interior surface 68A with the rear radial face 72A of the collar 66A. There is a chamfer at the junction of the interior surface 68A with the front radial face of the collar 66A. The retainer has a sleeve 78A and a bore in the sleeve defines an internal surface 80A of the second portion 58A. The retainer 24A is made of a material that is at least translucent, and preferably substantially transparent. Transparent polycarbonate is an example of a suitable material, although others are possible. As described above, the retainer is relatively flexible compared to a metal component and it allows for visibility into the interior of the retainer 24A when inserting the free end of a cable. This is especially useful in the BNC type connector.

Turning now to details of the bushing 26A, as in the previous embodiment it is made of a substantially rigid material, such as brass. The bushing includes a sleeve 82A with a bore therethrough that defines an interior surface 84A. The inside diameter of the bushing's sleeve 82A and the outside diameter of the retainer's sleeve 78A are selected to permit a telescoping engagement of the bushing on the retainer. However, as mentioned above, the outside diameter of the retainer's collar 66A is somewhat greater than the outside diameter of the retainer's sleeve 78A. As a result of the relationship between the inner and outer diameters of the bushing and the retainer's collar, respectively, and the retainer being more flexible than the bushing, sliding engagement of the bushing's sleeve 82A onto the collar 66A creates interference that causes the bushing to bias the retainer radially toward the mandrel 22A.

Continuing with the details of the bushing, a rib-receiving groove 86A is formed near the front end of the bushing. The rear end of the sleeve 82A joins a radially-extending collar 90A which has a counterbore 92A through it. The collar 90A retains a back seal 100 inside the bushing. When the bushing is moved to the compressed state of FIG. 10 the back seal 100 engages the outer jacket of a cable and pinches it between the back seal and the mandrel to retain the connector on the cable.

The front portion of the BNC connector 10A has several components that have no counterpart in the F connector 10. These include the collar contact 102. The collar contact is a generally cylindrical member having an external flange 104 and an internal flange 106. The rear end of the collar contact is press fit over the shoulder 48A of the mandrel 22A. A plurality of axial slots 108 at the front end of the collar contact 102 define spring-like fingers for engagement with a port. The internal flange 106 traps a dielectric mounting block 110 between it and the front surface of shoulder 48A. The mounting block is press fit into the collar contact just behind the flange 106. The mounting block has a central bore therethrough which flares outwardly at the rear end. The front end of the bore mounts a pin 112 which has a hollow rear portion into which a center conductor contact 114 fits. The flared bore and contact 114 receive the central conductor of a cable therethrough. The central conductor ends up in the hollow portion of the pin 112 if the cable is fully seated in the connector. But as evident in FIGS. 9 and 10, the user cannot look in the front end of the head 28A and see where the cable is because the cable is completely obscured from view by the pin 112, mounting block 110 and internal flange 106. This is why the non-opaque retainer provides such an advantage in this construction, because it allows the user to see whether the outer insulative jacket of the cable is properly seated against the rear radial face 72A of the retainer.

The front portion of the connector is completed by a front and rear washers 116, 118. the front washer bears against the external flange 104 and engages a shoulder of the head 28A.

Rear washer fits into a notch inside the trailing edge of the head 28A. A spring 120 resides between the washers to bias the head 28A rearwardly.

The use, operation and function of the connector of FIGS. 8-10 is similar that of the connector of FIGS. 1-7. The prepared end of the cable is inserted into the bushing and pushed forwardly until cable the central conductor 14 fits into the pin 112. At this point the outer jacket bottoms on the rear radial face 72A of the collar 66A. The non-opaque retainer 24A allows the user to visually confirm that the braided sleeve of the shield 18 and the jacket 20 have been fully inserted into the cavity between the retainer and the mandrel. When the user has confirmed that the cable is fully inserted into the connector 10A, the bushing 26A is compressed axially along the retainer 24A until the position of FIG. 10 is reached. This is typically done with the aid of a tool. As the bushing reaches the second, closed position the back seal 100 of the bushing will engage the jacket 20 of the cable and pinch the jacket between the bushing and the barb 36 of the mandrel. This prevents retraction of the cable from the connector.

Also, when the bushing moves to the second, closed position the front edge of the bushing engages the outside diameter of the retainer's collar 66A. As explained above, the inside diameter of the bushing's front end is less than the outside diameter of the collar so that interference is created when these two components engage. Since the bushing is more rigid than the collar 66A, the collar is compressed radially by the forwardly moving bushing. This radial compression causes the interior surface 68A of the collar to engage the seat surface 46A of the mandrel in sealing engagement. Thus, the retainer and mandrel are sealed against entry of moisture into the cavity by the closing motion of the bushing, which creates the biasing force on the retainer that in turn creates the seal.

In a preferred embodiment at least the surfaces involved in the sliding contact between the retainer and bushing are lubricated by a dry film lubricant, such as a synthetic wax emulsion. The lubricant reduces the friction of the bushing on the retainer. This makes it easier to get quad cables to enter the connector and makes the bushing slide more easily. The mandrel may also be similarly lubricated. The presence of lubricant reduces the cable insertion force significantly. This allows the connector to accept a wider range of cable sizes and types, which is one of the factors which combines with other features to make the connector more universal.

FIG. 11 illustrates an alternate form of an F connector according to the present disclosure. This embodiment has several components that are similar to those of FIGS. 1-7 and these will be given the same reference numerals with the addition of a letter B. Connector 10B includes a mandrel 22B, a non-opaque retainer 24B and a bushing 26B. Attachment element 28B is in the form of a nut. These components generally have a similar structure and operate similarly to those of the FIG. 7 embodiment with the exception of the rear end of the bushing 26B. The rear end of bushing 26B has a similar structure and operates similarly to that of the FIG. 8-10 embodiment. That is, bushing 26B has a sleeve 82B which joins a radially-extending collar 90B which has a counterbore 92B through it. The collar 90B retains a back seal 100B inside the bushing. When the bushing is moved to the compressed state the back seal 100B engages the outer jacket of a cable and pinches it between the back seal and the mandrel to retain the connector on the cable.

While this invention has been described with reference to certain illustrative aspects, it will be understood that this description shall not be construed in a limiting sense. Rather, various changes and modifications can be made to the illustrative embodiments without departing from the true spirit and scope of the invention, as defined by the following claims. Furthermore, it will be appreciated that any such changes and modifications will be recognized by those skilled in the art as an equivalent to one or more elements of the following claims, and shall be covered by such claims to the fullest extent permitted by law. For example, while two locating members are shown to fix the axial position of the retainer, one on either side of the retainer's collar, this arrangement could be otherwise. A single rib and groove could be used to hold the retainer in place. Also, alternatives to the bushing's collar are possible for retaining the connector on the cable. For example, the crimping ring of U.S. Pat. No. 6,089,913 could be used. Or the inner collar arrangement of U.S. Pat. No. 6,848,939 could be used. Also, while the shield is most commonly intended to reside outside of the mandrel when the cable is installed, it will be understood that other arrangements with respect to the shield are possible. In particular, since the shield could include multiple foil layers and/or multiple braid layers, inner ones of these layers may go inside the mandrel while outer layers may end up outside the mandrel.

I claim:

1. A coaxial cable connector for attaching a coaxial cable to a port of a device, the coaxial cable being of the type having a central conductor, a dielectric core surrounding the central conductor, a conductive shield surrounding the dielectric core and an insulative jacket surrounding the shield, the connector comprising:

a mandrel having a wall that defines an interior cylindrical bore, the exterior of the wall including a seat surface and at least one locating member, the cylindrical bore defining an axis and being sized for receiving at least the central conductor and dielectric core of a coaxial cable inserted into the connector;

a retainer having a first portion in facing relation with the seat surface and in engagement with the locating member of the mandrel to axially fix the retainer to the mandrel, the retainer also having a second portion spaced from the mandrel to define a cavity between the exterior of the mandrel and an internal surface of the second portion of the retainer, the cavity being sized for receiving the at least a portion of the shield and the jacket of a coaxial cable inserted into the connector;

a bushing engageable with the retainer and axially moveable with respect thereto from a first, open position, wherein the bushing is spaced from the first portion of the retainer and the first portion of the retainer is in non-sealing relation with the seat surface of the mandrel, to a second, closed position, wherein the bushing engages the first portion of the retainer to bias it into sealing engagement with the seat surface.

2. The coaxial cable connector of claim 1 wherein the first portion of the retainer includes a radially-extending collar having a counterbore which defines an interior surface which is engageable with the seat surface.

3. The coaxial cable connector of claim 2 wherein the second portion of the retainer includes an axially-extending sleeve attached to the collar, the sleeve having a bore which defines an internal surface whose inside diameter is greater than the exterior diameter of the mandrel wall so the sleeve's internal surface is spaced from the mandrel wall to define the cavity.

4. The coaxial cable connector of claim 3 wherein the locating member includes a shoulder and rib which are axially spaced to receive the collar between them.

5. The coaxial cable connector of claim 4 wherein the shoulder and rib receive the collar therebetween in a snap fit.

6. The coaxial cable connector of claim 2 wherein the locating member includes a shoulder and rib which are axially spaced to receive the collar between them.

7. The coaxial cable connector of claim 6 wherein the shoulder and rib receive the collar therebetween in a snap fit.

8. The coaxial cable connector of claim 1 wherein the retainer is made of a material that is translucent.

9. The coaxial cable connector of claim 1 further comprising an attachment element non-releasably engageable with at least one of the mandrel and the retainer and releasably engageable with the port.

10. The coaxial cable connector of claim 1 wherein the first portion of the retainer includes a radially-extending collar having a counterbore which defines an interior surface which is in facing relation with the seat surface and the second portion of the retainer includes an axially-extending sleeve attached to the collar, the collar having an outside diameter greater than that of the sleeve, the bushing being slidably engageable with the outer surface of the retainer and having an inside diameter that creates interference with the collar when the bushing is moved to the second, closed position, the retainer being more flexible than the bushing such that said interference causes the collar to flex into sealing engagement with the seat surface.

11. The coaxial cable connector of claim 10 wherein the bushing includes a sleeve slidably engageable with the outer surface of the retainer and a radially-extending collar engageable with a coaxial cable inserted into the connector to prevent retraction of the coaxial cable from the mandrel.

12. The coaxial cable connector of claim 10 further comprising a rib formed on the external surface of the retainer's sleeve, a first rib-receiving groove formed in the internal surface of the bushing's sleeve for receiving the rib when the bushing is in the first, open position, and a second rib-receiving groove formed in the internal surface of the bushing's sleeve at a location axially spaced from the first rib-receiving groove for receiving the rib when the bushing is in the second, closed position.

13. A coaxial cable connector, comprising:

a generally tubular mandrel having a seat surface on its exterior;

a retainer surrounding a portion of the mandrel and having a first portion in facing relation with the seat surface of the mandrel;

a bushing mounted in telescoping relation with the retainer, the bushing being axially moveable to a closed position wherein the bushing engages the first portion of the retainer to bias it into sealing engagement with the seat surface.

14. The coaxial cable connector of claim 13 wherein the first portion of the retainer includes a radially-extending collar having a counterbore which defines an interior surface which is in facing relation with the seat surface, the retainer further including an axially-extending sleeve attached to the collar, the collar having an outside diameter greater than that of the sleeve, the bushing being slidably engageable with the outer surface of the retainer and having an inside diameter that creates interference with the collar when the bushing is moved to the second, closed position, the retainer being more flexible than the bushing such that said interference causes the collar to flex into sealing engagement with the seat surface.

15. In a coaxial cable connector of the type having a mandrel, a retainer having a first portion engaging the mandrel and a second portion spaced from the mandrel to define a cavity, a bushing engageable with the retainer and axially moveable with respect thereto from a first, open position to a second, closed position, the improvement comprising a method of assembling the connector on a coaxial cable including the steps of:

a) sliding the first portion of the retainer onto the mandrel and into non-sealing engagement with the external surface of the mandrel;

b) sliding the bushing onto the retainer to the first, open position;

c) inserting a prepared end of a coaxial cable into the mandrel and cavity; and d) moving the bushing from the first, open position to the second closed position wherein the bushing biases the first portion of the retainer into sealing engagement with the external surface of the mandrel.

16. A coaxial cable connector for attaching a coaxial cable to a port of a device, the coaxial cable being of the type having a central conductor, a dielectric core surrounding the central conductor, a conductive shield surrounding the dielectric core and an insulative jacket surrounding the shield, the connector comprising:

a generally tubular mandrel having a wall that defines an interior cylindrical bore, the cylindrical bore defining an axis and being sized for receiving at least the central conductor and dielectric core of a coaxial cable inserted into the connector;

a retainer having a first portion connected to the mandrel and a second portion spaced from the mandrel to define a cavity between the exterior of the mandrel and an internal surface of the second portion of the retainer, the cavity being sized for receiving at least a portion of the shield and the jacket of a coaxial cable inserted into the connector, at least the second portion of the retainer being sufficiently translucent to permit visual observation of a jacket inserted in the cavity; and a bushing mounted in telescoping relation with the retainer, the bushing being adapted for axial movement along the retainer.

17. The cable connector of claim 16 wherein the exterior of the mandrel wall includes a seat surface and at least one locating member;

the retainer's first portion is in facing relation with the seat surface and in engagement with the locating member of the mandrel to axially fix the retainer to the mandrel; and the bushing is axially moveable from a first, open position, wherein the bushing is spaced from the first portion of the retainer and the first portion of the retainer is in non-sealing relation with the seat surface of the mandrel, to a second, closed position, wherein the bushing engages the first portion of the retainer to bias it into sealing engagement with the seat surface.

18. A coaxial cable connector, comprising:

a generally tubular mandrel;

a retainer engageable with the mandrel, at least a portion of the retainer being sufficiently translucent to permit visual observation of a jacket inserted into the retainer;

a bushing mounted in telescoping relation with the retainer, the bushing and retainer having surfaces slidably engageable with one another to permit axial sliding movement of the bushing along the retainer to a closed position; and a lubricant placed between the slidably engageable surfaces of the retainer and bushing.

19. The connector of claim 18 further characterized in that the mandrel has a seat surface on its exterior, and the retainer surrounds a portion of mandrel and has a first portion in facing relation with the seat surface of the mandrel, and wherein the bushing engages the first portion of the retainer and the bushing engages the retainer to bias it into sealing engagement with the seat surface.

20. The coaxial cable connector of claim 19 wherein the first portion of the retainer includes a radially-extending collar having a counterbore which defines an interior surface which is in facing relation with the seat surface, the retainer further including an axially-extending sleeve attached to the collar, the collar having an outside diameter greater than that of the sleeve, the bushing being slidably engageable with the outer surface of the retainer and having an inside diameter that creates interference with the collar when the bushing is moved to the closed position, the retainer being more flexible than the bushing such that said interference causes the collar to flex into sealing engagement with the seat surface.

21. A coaxial cable connector, comprising:

a generally tubular mandrel;

a retainer surrounding a portion of the mandrel and having a first portion in engagement with the mandrel, at least a portion of the retainer being sufficiently translucent to permit visual observation of a coaxial cable inserted into the retainer; and a bushing mounted in telescoping relation with the retainer, the bushing being axially moveable to a closed position.

* * * * *